US008548716B2

(12) United States Patent
Wang et al.

(10) Patent No.: US 8,548,716 B2
(45) Date of Patent: Oct. 1, 2013

(54) VARIABLE CAM CONTROL IN AN ENGINE

(75) Inventors: Yan Wang, Ann Arbor, MI (US); Jeffrey Allen Doering, Canton, MI (US); Joseph Norman Ulrey, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 41 days.

(21) Appl. No.: 13/303,658

(22) Filed: Nov. 23, 2011

(65) Prior Publication Data

US 2013/0125847 A1 May 23, 2013

(51) Int. Cl.
*F01L 1/344* (2006.01)

(52) U.S. Cl.
USPC ..... 701/103; 123/90.15; 123/406.63

(58) Field of Classification Search
USPC ..... 701/103; 123/90.15–90.18, 406.63
See application file for complete search history.

(56) References Cited

U.S. PATENT DOCUMENTS

| | | | | |
|---|---|---|---|---|
| 5,329,904 | A * | 7/1994 | Kokubo et al. | 123/406.53 |
| 5,333,586 | A * | 8/1994 | Fukui | 123/406.58 |
| 5,345,909 | A * | 9/1994 | Fukui et al. | 123/406.58 |
| 5,469,823 | A * | 11/1995 | Ott et al. | 123/406.62 |
| 5,632,246 | A * | 5/1997 | Fukui et al. | 123/406.18 |
| 6,302,085 | B1 * | 10/2001 | Sekine et al. | 123/406.62 |
| 6,932,033 | B2 * | 8/2005 | Jiang | 123/90.15 |
| 6,946,830 | B1 * | 9/2005 | Hayashi et al. | 324/207.25 |
| 7,403,849 | B1 | 7/2008 | Watanabe et al. | |
| 7,721,693 | B2 * | 5/2010 | Nguyen et al. | 123/90.17 |
| 7,819,106 | B2 * | 10/2010 | Kondo | 123/406.6 |
| 2005/0268887 | A1 * | 12/2005 | Campbell | 123/406.59 |
| 2006/0027197 | A1 * | 2/2006 | Tagami et al. | 123/90.17 |
| 2007/0295295 | A1 | 12/2007 | Kobayashi et al. | |
| 2009/0210237 | A1 | 8/2009 | Shen et al. | |
| 2009/0255510 | A1 * | 10/2009 | Mashiki et al. | 123/347 |
| 2010/0242880 | A1 * | 9/2010 | Watanabe et al. | 123/90.17 |
| 2011/0048346 | A1 * | 3/2011 | Crowe et al. | 123/90.12 |
| 2012/0055429 | A1 * | 3/2012 | Nakamura et al. | 123/90.17 |

* cited by examiner

*Primary Examiner* — Erick Solis
(74) *Attorney, Agent, or Firm* — Julia Voutyras; Alleman Hall McCoy Russell & Tuttle LLP

(57) ABSTRACT

A method for controlling variable camshaft timing is provided. In one example, an engine method comprises adjusting a variable cam actuator responsive to cam position feedback from even and uneven readings of a cam sensor. In this way, increased cam position feedback may be provided to improve cam positioning control.

20 Claims, 6 Drawing Sheets

VARIABLE CAM CONTROL IN AN ENGINE

FIELD

The present disclosure relates to controlling a variable camshaft timing system of an engine.

BACKGROUND AND SUMMARY

Engines may utilize variable cam operation to adjust intake and exhaust valve operation in an engine cylinder. For example, the cam timing may be adjusted to improve engine operation across a range of conditions. In one example, a control system maintains the cam timing relative to crankshaft timing based on feedback information from cam and crankshaft sensors.

U.S. Pat. No. 6,932,033 describes one approach to control cam timing based on a toothed cam wheel with an additional index tooth. The index tooth indicates when a torque reversal occurs on the camshaft. The control system adjusts the cam actuator based on this information to provide improved cam timing control. Additionally, the uneven tooth can provide identification information used during engine starting to identify engine position, as the crankshaft does not uniquely identify engine position in a four-cycle engine.

The inventors herein have recognized some issues with the above approach. For example, while an increased number of evenly spaced teeth provide an increased data rate of sensed cam position, the single uneven tooth may lead to longer engine cranking. For example, up to two full crankshaft revolutions may occur before the uneven tooth is identified in order to identify engine position and commence sequential fuel injection. On the other hand, reducing the number of evenly spaced teeth in order to provide earlier engine position identification can lead to reduced data rates of sensed position during engine running.

The inventors herein have recognized that this apparent paradox can be at least partially addressed by incorporating information from uneven tooth edges into the feedback control of cam operation in one embodiment. For example, an engine method includes adjusting a variable cam actuator responsive to cam position feedback from even and uneven readings of a cam sensor.

In this way, it is possible to provide quick engine position identification during an engine start through a plurality of uneven tooth edges, while maintaining a high data rate of sensed cam position, and thus accurate control of cam operation, from both even and uneven tooth edges.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
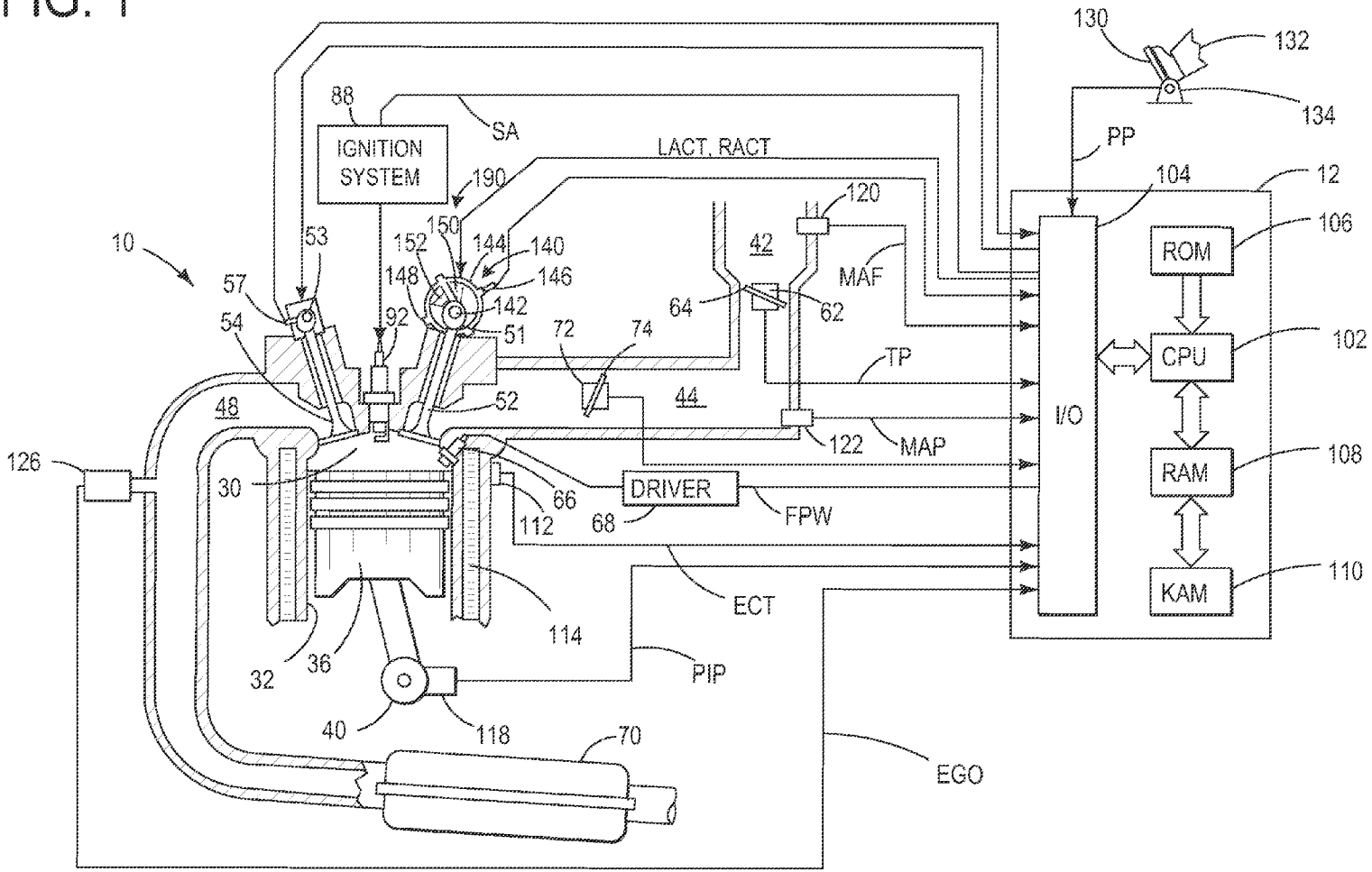
FIG. 1 shows an example engine including a cylinder according to an embodiment of the present disclosure.
Figure 2:
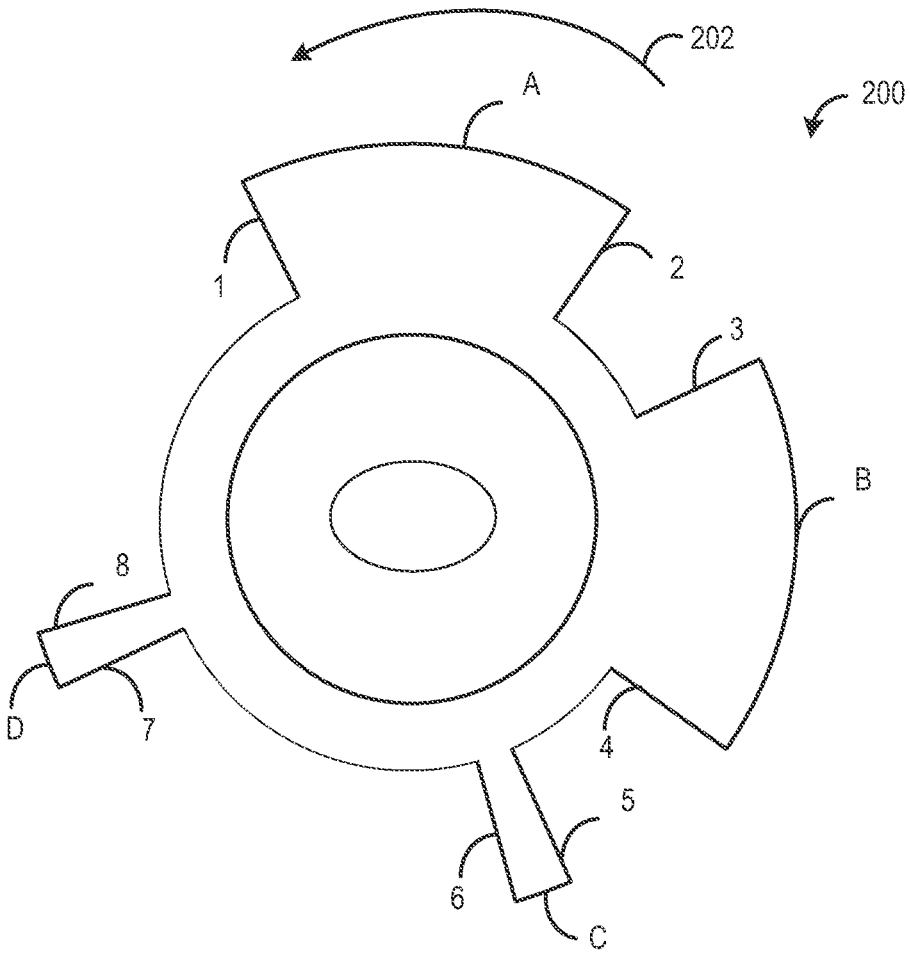
FIG. 2 shows an example cam wheel having evenly and unevenly spaced tooth edges.
Figure 6:
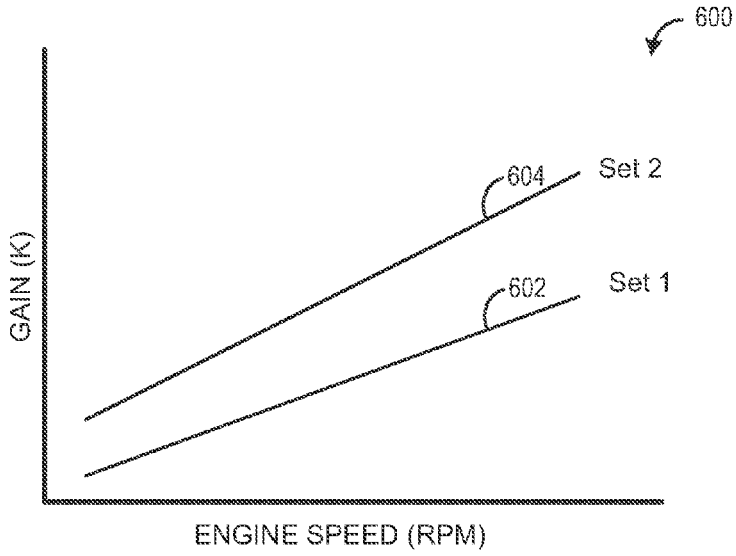
FIG. 6 is diagram illustrating two example controller gain sets according to an embodiment of the present disclosure.
Figure 7:
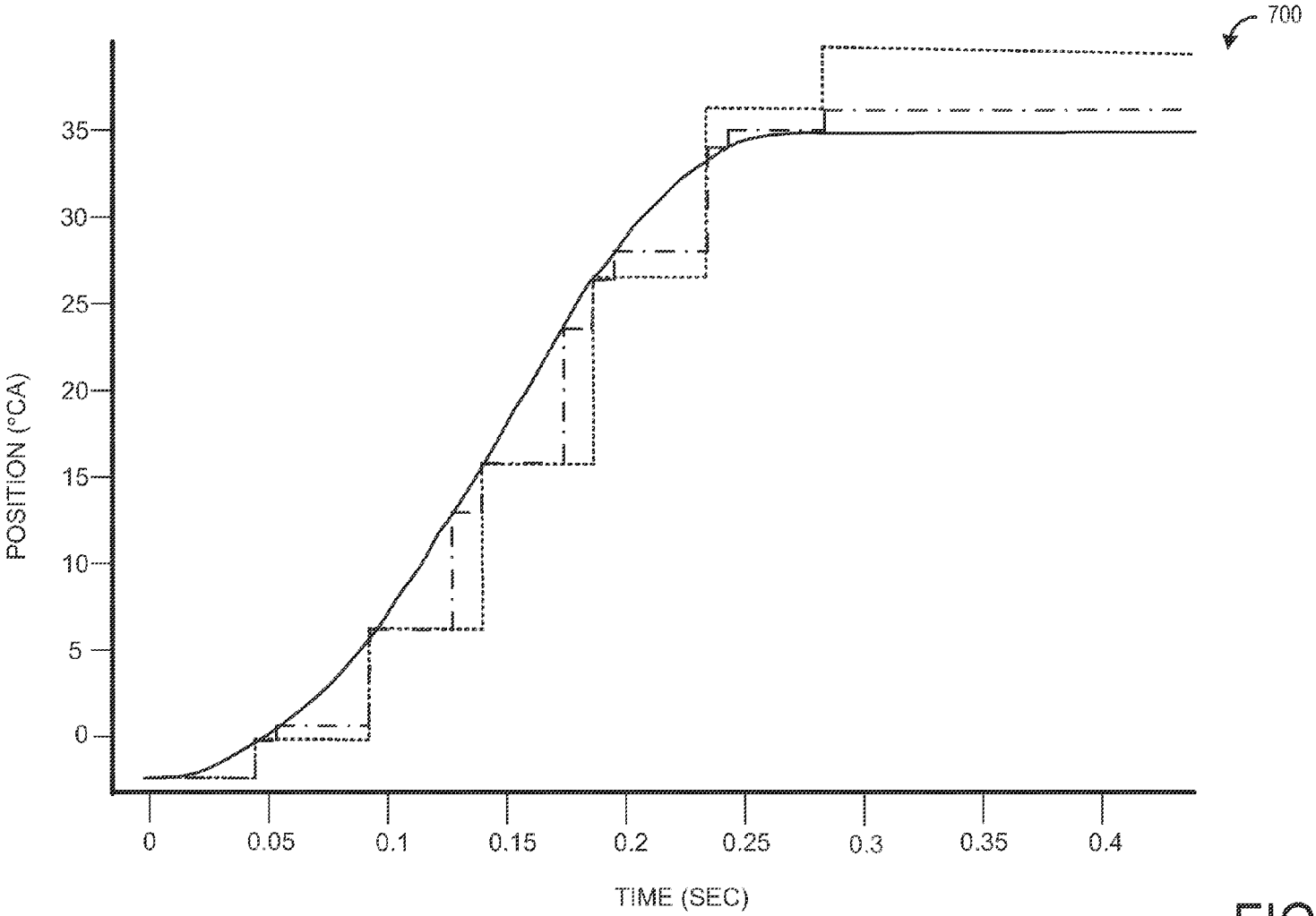
FIG. 7 is a diagram illustrating an example cam step response according to an embodiment of the present disclosure.

An engine having variable valve operation, such as variable cam timing, is described in FIG. 1, which shows an example cylinder. The cylinder includes variable intake and/or exhaust valve timing adjusted via one or more valve actuators. A controller maintains valve timing at a desired value based on feedback of the cam position relative to crankshaft position. An example cam wheel sensor for providing the feedback is illustrated in FIG. 2 having both even and uneven edge spacing from variable width and variably positioned teeth. The system is controlled by the controller according to various routines, illustrated in FIGS. 3-5. Specifically, the routine of FIG. 3 manages the control of the valve actuator based on sensor feedback information, including from the cam sensor and crank angle sensors. Depending on operating conditions, different data gathering and processing is provided. For example, to provide improved data rate cam timing sensing information, the feedback control adjustments are based on readings from both evenly spaced and unevenly spaced tooth edges. However, at higher engine speeds, only the evenly spaced tooth edges are used to save data processing and computational power. FIG. 6 illustrates two example gain sets which may be used to differentially process the timing information received from the cam wheel sensor. FIG. 7 illustrates an example cam position response using the above-described feedback control adjustments.

Referring now to FIG. 1, it shows a schematic diagram of one cylinder of multi-cylinder engine 10, which may be included in a propulsion system of an automobile. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e., cylinder) 30 of engine 10 may include combustion chamber walls 32 with piston 36 positioned therein. In some embodiments, the face of piston 36 inside combustion chamber 30 may have a bowl. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves.

Intake valve 52 may open and close according to lobes of intake cam 51. Similarly, exhaust valve 54 may open and close according to lobes of exhaust cam 53. Phase of intake cam 51 and exhaust cam 53 may be varied with respect to crankshaft 40. Alternatively, the variable valve actuator may be electro hydraulic or another mechanism to enable valve actuation. During some conditions, controller 12 may vary the signals provided to actuators coupled to intake cam 51 and exhaust cam 53 to control the opening and closing timing of the respective intake and exhaust valves. The position of intake valve 52 and exhaust valve 54 may be determined by valve position sensors 146 and 57, respectively. In alternative embodiments, one or more of the intake and exhaust valves may be actuated by one or more cams, and may utilize one or more of cam profile switching (CPS), variable cam timing (VCT), variable valve timing (VVT) and/or variable valve lift (VVL) systems to vary valve operation. For example, cylinder 30 may alternatively include an intake valve controlled via electric valve actuation and an exhaust valve controlled via cam actuation including CPS and/or VCT.

Fuel injector 66 is shown coupled directly to combustion chamber 30 for injecting fuel directly therein in proportion to the pulse width of signal FPW received from controller 12 via electronic driver 68. In this manner, fuel injector 66 provides what is known as direct injection of fuel into combustion chamber 30. The fuel injector may be mounted in the side of the combustion chamber or in the top of the combustion chamber, for example. Fuel may be delivered to fuel injector 66 by a fuel system (not shown) including a fuel tank, a fuel pump, and a fuel rail.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Intake passage 42 may include throttles 62 and 63 having throttle plates 64 and 65, respectively. In this particular example, the positions of throttle plates 64 and 65 may be varied by controller 12 via signals provided to an electric motor or actuator included with throttles 62 and 63, a configuration that is commonly referred to as electronic throttle control (ETC). In this manner, throttles 62 and 63 may be operated to vary the intake air provided to combustion chamber 30 among other engine cylinders. The positions of throttle plates 64 and 65 may be provided to controller 12 by throttle position signals TP. Pressure, temperature, and mass air flow may be measured at various points along intake passage 42 and intake manifold 44. For example, intake passage 42 may include a mass air flow sensor 120 for measuring clean air mass flow entering through throttle 63. The clean air mass flow may be communicated to controller 12 via the MAF signal.

Exhaust passage 48 can receive exhaust gases from other cylinders of engine 10 in addition to cylinder 30. Exhaust gas sensor 126 is shown coupled to exhaust manifold 48 upstream of catalytic converter 70 (where sensor 76 can correspond to various different sensors). For example, sensor 126 may be any of many known sensors for providing an indication of exhaust gas air/fuel ratio such as a linear oxygen sensor, a UEGO, a two-state oxygen sensor, an EGO, a HEGO, or an HC or CO sensor.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft.

Storage medium read-only memory 106 can be programmed with computer readable data representing instructions executable by processor 102 for performing the methods described below as well as other variants that are anticipated but not specifically listed.

Continuing with FIG. 1, a variable camshaft timing (VCT) system 190 is shown. While only a variable camshaft timing system is shown for the system of intake valve 52, in some embodiments, the system of exhaust valve 54 may include a variable camshaft timing system in addition to or in place of the variable camshaft timing system 190 for intake valve 52. Camshaft 142 of engine 10 is shown communicating with lobe 51 for actuating intake valve 52. VCT system 190 may be oil-pressure actuated (OPA), cam-torque actuated (CTA), or a combination thereof. By adjusting a plurality of hydraulic valves to thereby direct a hydraulic fluid, such as engine oil, into the cavity (such as an advance chamber or a retard chamber) of a camshaft phaser 140, valve timing may be changed, that is advanced or retarded. The operation of the hydraulic control valves may be controlled by respective control solenoids. Specifically, an engine controller may transmit a signal to the solenoids to move a valve spool that regulates the flow of oil through the phaser cavity. As used herein, advance and retard of cam timing refer to relative cam timings, in that a fully advanced position may still provide a retarded intake valve opening with regard to top dead center, as just an example.

Camshaft 142 is directly coupled to housing 144. Housing 144 forms a toothed wheel having a plurality of teeth 148. Housing 144 is hydraulically coupled to crankshaft 40 via a timing chain or belt (not shown). Therefore, housing 144 and camshaft 142 rotate at a speed substantially equivalent to the crankshaft or a multiple thereof. However, by manipulation of the hydraulic coupling as will be described later herein, the relative position of camshaft 142 to crankshaft 40 can be varied by hydraulic pressures in advance chamber 150 and retard chamber 152. By allowing high pressure hydraulic fluid to enter advance chamber 150, the relative relationship between camshaft 142 and crankshaft 40 is advanced. Thus, intake valve 52 opens and closes at a time earlier than normal relative to crankshaft 40. Similarly, by allowing high pressure hydraulic fluid to enter retard chamber 152, the relative relationship between camshaft 142 and crankshaft 40 is retarded. Thus, intake valve 52 opens and closes at a time later than normal relative to crankshaft 40.

While this example shows a system in which only the intake valve timing is controlled, concurrent intake and exhaust cam timing, variable exhaust cam timing, dual independent variable cam timing, dual equal variable cam timing, or fixed cam timing may be used. Further, variable valve lift may also be used. Camshaft profile switching may be used to provide different cam profiles under different operating conditions. Further still, the valvetrain may be roller finger follower, direct acting mechanical bucket, electromechanical, electrohydraulic, or other alternatives.

Continuing with the variable cam timing system, teeth 148, being coupled to housing 144 and camshaft 142, allow for measurement of relative cam position via cam timing sensor 146 providing signal VCT to controller 12. Teeth, such as tooth 148, may be used for measurement of cam timing and may have at least some edges that are equally spaced (for example, spaced 180 degrees apart from one another) and edges that are unequally spaced. In addition, controller 12 sends control signals (LACT, RACT) to conventional solenoid valves (not shown) to control the flow of hydraulic fluid either into advance chamber 150, retard chamber 152, or neither.

Relative cam timing can be measured in a variety of ways. In general terms, the time, or rotation angle, between the rising edge of the PIP signal and receiving a signal from one of the plurality of teeth 148 on housing 144 gives a measure of the relative cam timing. Additional details on measuring cam timing are described below. Under some conditions in the example of a V-8 engine, with two cylinder banks and toothed wheel with four even and four uneven teeth edges, an equally spaced measure of cam timing for a particular bank is received four times per revolution, with the uneven edges used for cylinder identification. However, under other conditions, a measure of cam timing may be based on both evenly spaced tooth edges and unevenly spaced tooth edges.

As described above, FIG. 1 shows only one cylinder of a multi-cylinder engine, and that each cylinder may similarly include its own set of intake/exhaust valves, fuel injector, spark plug, etc.

Referring now to FIG. 2, it illustrates an example cam wheel 200, drawn approximately to scale. Cam wheel 200 may be used to measure cam timing based on both even and uneven tooth edges. The housing 144 with teeth 148 coupled to camshaft 142 as described above with respect to FIG. 1 may be one non-limiting example of cam wheel 200.

Cam wheel 200 includes a plurality of teeth, A-D, including two teeth C, D that are narrower in width (rotational angle) and two teeth A, B that are wider in width. The narrow teeth C, D may be arranged adjacent on cam wheel 200.

Each tooth has a rising edge and a falling edge, relative to the axis of rotation of the cam wheel 200. As depicted in FIG. 2, cam wheel 200 may rotate in a counter-clockwise direction (as indicated by arrow 202), and as such edges 1, 7, 5, and 3 may be the falling edges, and edges 8, 6, 4, 2 may be the rising edges. Falling edges 1, 7, 5, and 3 are evenly spaced, that is, an equal number of crankshaft degrees separate each edge. However, rising edges 8, 6, 4, and 2 are unevenly spaced, with an unequal number of crankshaft degrees separating the edges. In the depicted embodiment, falling edges are each spaced by 180° CA, while rising edges 8 and 6 are spaced by 164° CA, edges 6 and 4 are spaced by 80° CA, edges 4 and 2 are spaced by 180° CA, and edges 2 and 8 are spaced by 296° CA. However, rising edges 8, 6, 4, and 2 may be spaced by another suitable, non-even amount.

Thus, the cam wheel 200 may include four teeth, with two teeth having a smaller tooth width and two teeth having a greater tooth width. One edge of each tooth may be evenly spaced around the wheel to generate the even readings, and another edge of each tooth may be unevenly spaced around the wheel to generate the uneven readings.

Figure 3:
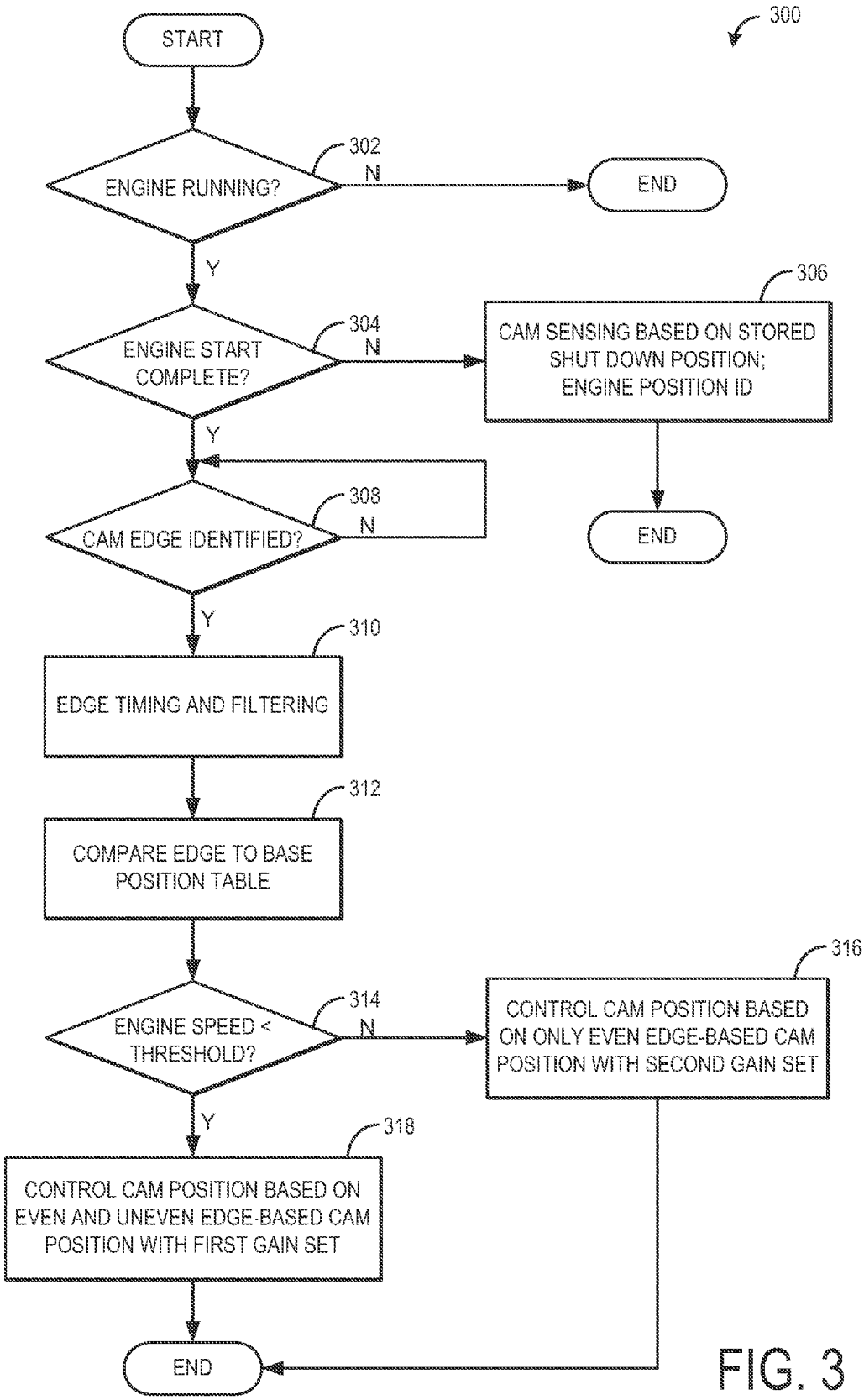
FIG. 3 is a flow chart illustrating an example control routine for controlling valve timing operation.

Referring now to FIG. 3, a high-level routine 300 is described for controlling valve timing operation in engine 10. Routine 300 may be carried out by a control system of the engine, such as controller 12.

At 302, the routine determines if the engine is running. If not, routine 300 ends. If the engine is running, routine 300 proceeds to 304 to determine if engine start is complete. During start of the engine, the engine may be cranked by a starter motor, for example, rather than operating with fuel injection. If the engine start is not complete (e.g., the engine is still cranking), routine 300 continues to 306 to determine engine position during engine cranking so that sequential fuel injection can commence. In one example, the routine identifies crankshaft position from the crankshaft sensor in order to identify that the engine is in one of two positions. Then, the position is selected form the two options based on identification of engine position via one or more cam sensor readings. For example, the routine may identify the location of rising and falling edges of the toothed cam wheel sensor and once enough edges have been detected to identify the pattern and determine cam position, engine position is identified. For example, the routine may identify cam position from one of four patterns including: narrow-narrow; narrow-wide; wide-wide; and wide-narrow.

Additionally, or alternatively, engine position and cam position may be stored upon shutdown, and then assumed to have remained substantially fixed during the shutdown such that engine position and cam position are known upon engine start, even before any toothed cam wheel sensor edges are detected.

Additionally, cam timing may be controlled during engine start/cranking based on the stored shutdown information to move the cam timing to a desired position for engine starting, such that the cam timing may be adjusted before a first combustion event in a cylinder from engine rest.

Continuing with FIG. 3, if engine start is complete, at 308 routine 300 determines if a rising or falling edge of the toothed cam wheel has been identified, similar to the mechanism described above for sensing one of the four tooth patterns. If no edge has been identified, routine 300 continues back to 308 to continue to monitor for identification of an edge. If an edge has been identified, the edge timing is determined and filtered at 310. The filtering may include digital filtering to remove selected noise frequencies, such as firing frequency and multiples thereof.

The determined edge timing is compared to a base position table at 312. The base position table may be stored in the memory of the controller, and may include position timing for each edge of the cam wheel at the base position, e.g., the normal, non-adjusted cam position. An example base position table, Table 1, is described in more detail below.

At 314, routine 300 determines if engine speed is below a threshold. The threshold engine speed may be a speed below which the control response timing for adjusting cam position based on operating parameters may exceed the feedback response timing from the even edges, e.g., 600 RPM. If the answer is yes, and engine speed is below the threshold, cam position may be controlled at 318 based on even and uneven edge-based cam position with a first gain set in order to increase the feedback response timing and take advantage of the higher data rate sensor information regarding cam timing.

At 316, if the engine speed is not below the threshold, the cam position may be controlled based on only even edge-based cam position with a second gain set. Upon controlling cam position, routine 300 exits.

In this way, increased samples of cam timing during low speed operation can be provided. The above-described adjusting of the variable cam actuator may occur during feedback position control of cam timing during warmed-up engine operation. In one embodiment, the cam position may be a relative angle between cam position and crankshaft position, measured in crankshaft angle degrees, and the relative angle may be further relative to a base cam position. Further, control routine 300 provides for adjusting a variable cam actuator responsive to cam position feedback from even and uneven readings of a cam sensor. This adjusting may be responsive to cam position feedback from even and uneven readings during engine speed below a threshold speed, and adjusted responsive to cam position feedback from only the even readings when engine speed is above the threshold speed. During engine speed operation below the threshold, a first controller gain may adjust the variable cam actuator responsive to an error between a desired position (e.g., a position set by the controller based on operating parameters) and the feedback cam position, and during engine speed operation above the threshold, a second controller gain may adjust the variable cam actuator responsive to the error between the desired position and the feedback cam position.

The two different gains, or gain sets in one example, utilized in the above described control routine may be selected based on engine speed as described. For example, the first set may be used at engine speeds below the threshold while the second set may be used at engine speeds above the threshold. The gain sets may be determined based on an off-line model to optimize the control performance and minimize noise, based on engine speed, and stored in the controller memory. However, in some embodiments, the controller gains may be based on other parameters, such as even/uneven readings. In this way, a first feedback control adjustment gain may be applied when using feedback based on only even readings, and a second, different feedback control adjustment gain may be applied to feedback from both even and uneven readings. In this way, it is possible to take advantage of the higher data rate sensing at lower engine speeds by using a more optimized controller gain for these situations to provide faster control, while still retaining controller stability at both higher and lower engine speed ranges. Alternatively, a constant controller gain may be used at both high and low engine speed and with both even and unevenly spaced cam timing sensed positions.

Figure 4:
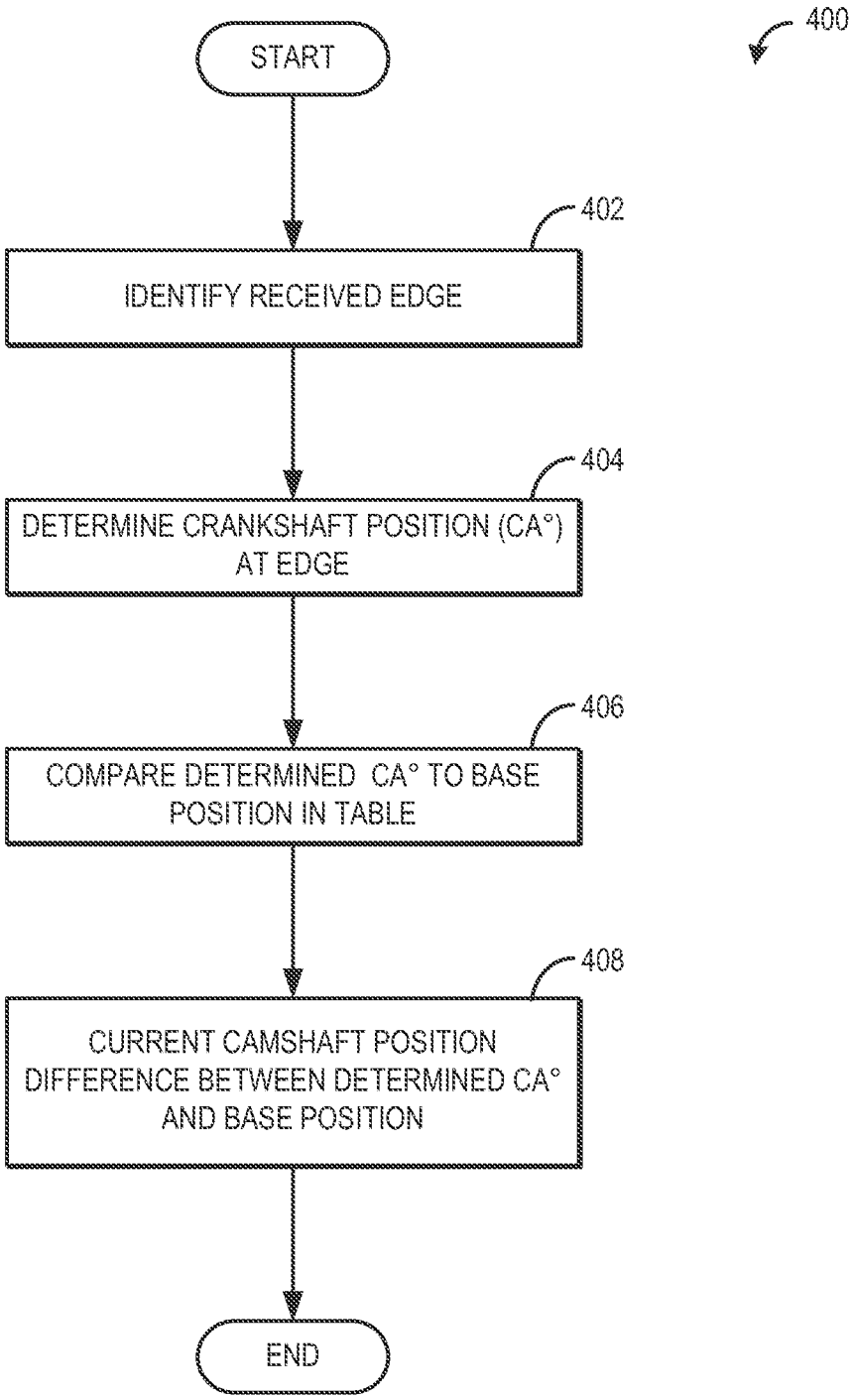
FIG. 4 is a flow chart illustrating an example control routine for identifying cam position relative to crankshaft position.

Referring now to FIG. 4, a routine 400 is described for identifying cam position relative to crankshaft position using tabulated data for a base timing at each of the known edge locations having uniquely identified crankshaft positions. Routine 400 may be carried out by controller 12 in response to feedback from camshaft and crankshaft position sensors, such as sensors 146 and 118. Routine 400 includes, at 402, identifying a cam wheel tooth edge. Identifying a cam wheel tooth edge may include identifying either a rising edge or a falling edge of a tooth of the cam wheel based on the pattern of received edges at the sensor. Once an edge is identified, routine 400 includes, at 404, determining the crankshaft angle corresponding to the identification of the received edge, e.g., the CA° at the time the edge is identified. For example, the routine may identify the edge as either rising or falling, and then based on which edge is received from a known tooth, the corresponding crankshaft angle is determined.

At 406, the determined CA° is compared to the base position in the base timing table stored in the memory of the controller, such as Table 1 below. At 408, the current camshaft angle is determined based on the difference between the determined CA° and the base position from the table. For example, if the identified edge has a crankshaft angle of 180° at the base position, but is identified at 185° CA, the camshaft position is determined to be advanced 5° CA.

Figure 5:
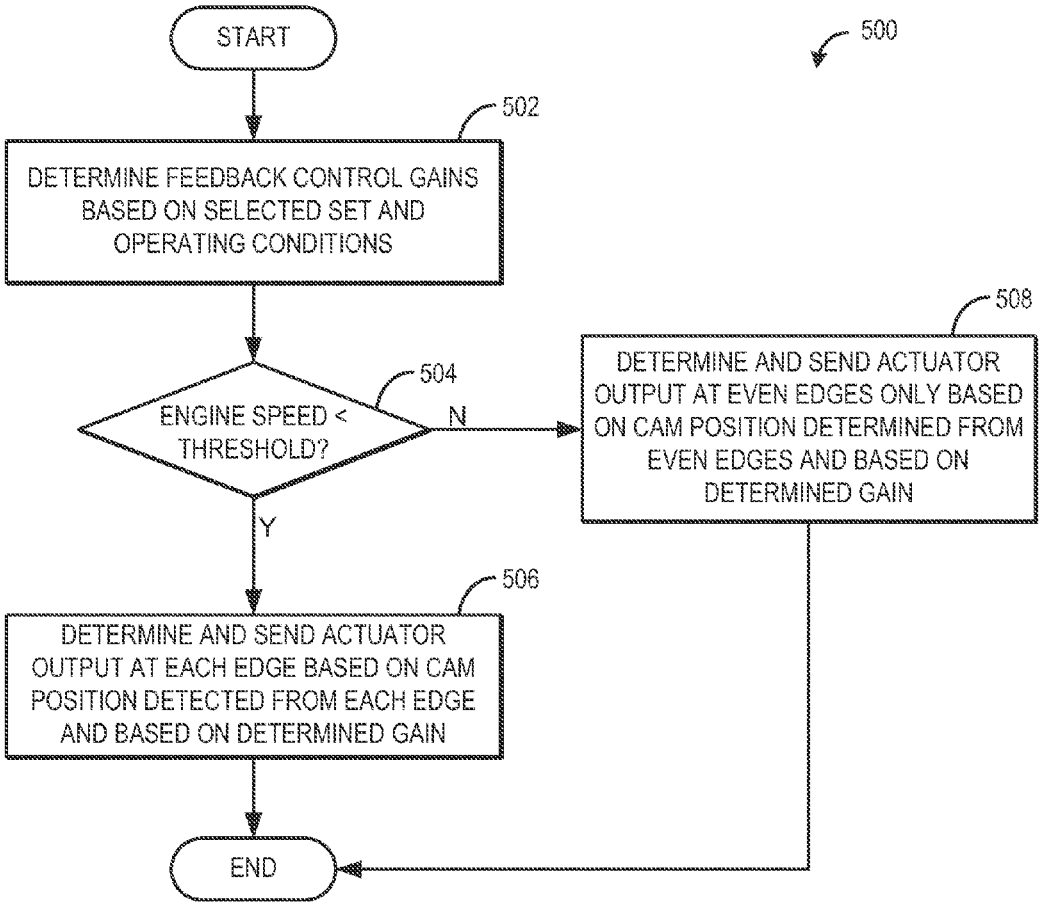
FIG. 5 is a flow chart illustrating an example control routine for reporting cam position using different sensor sampling rates depending on engine speed.

Referring now to FIG. 5, a routine 500 is described for utilizing different sensor sampling rates for feedback cam actuator control depending on engine speed. Specifically, cam position may be reported based on even edges only at high engine speed, and based on both even and uneven edges at low engine speed. Routine 500 includes, at 502, determining the feedback control gain based on a selected set and operating conditions, e.g., engine speed. For example, a first control gain set may be selected when engine speed is below a threshold, and a second control gain may be selected when engine speed is above the threshold. FIG. 6 shows an example graph 600 illustrating two gain sets based on engine speed, Set 1 602 and Set 2 604. In this example, Set 2 is increased compared to Set 1, and may be used at higher engine speeds. FIG. 6 will be discussed in more detail below.

At 504, routine 500 determines if engine speed is below a threshold, such as 600 RPMs. If engine speed is lower than the threshold, the cam position feedback provided by only the even edges may not be reported at a fast enough rate to maintain stable control performance (e.g., the control to the camshaft position may occur more frequently than the feedback). Thus, at 506, routine 500 includes determining and sending actuator output at each detected edge, including both the even and uneven edges. The actuator output may be based on the determined cam angle relative to crankshaft angle detected from each edge (as determined based on routine 400, described above with respect to FIG. 4), and further based on the selected gain set.

If engine speed is not below the threshold, the position reported by the even edges may be sufficient to maintain optimal control performance, and at 508, routine 500 includes determining and sending actuator output at the even edges only. This may be based on the determined cam angle relative to crankshaft angle detected from the even edges, and further based on the selected gain set. In one example, the controller update rate is interrupt driven upon receiving a sensed edge—with both rising and falling edges triggering a controller algorithm update and corresponding actuator signal update at lower engine speeds, and only even rising edges triggering the update at higher engine speeds.

In this way, the actuator output, such as movement of a valve spool to control the hydraulic fluid in a chamber of the cam phaser, may be controlled based on the determined cam position from either the even edges only, or from all edges, depending on engine speed. In one embodiment, during lower engine speeds, a variable cam timing (VCT) actuator may be adjusted responsive to cam timing feedback from even and uneven edge readings of a toothed cam sensor wheel. During higher engine speeds, the VCT actuator may be adjusted responsive to cam timing feedback only from even edge readings, and independent of the uneven readings, of the toothed cam sensor wheel.

In another example, the controller may include non-transitory code to adjust the actuator responsive to readings from both even and uneven edges during a first condition and responsive to readings from only even edges during a second condition. The first condition may include engine speed below a threshold, while the second condition may include engine speed above the threshold. The threshold engine speed may be constant, e.g., may be set in advance without changing regardless of engine conditions. However, in other embodiments, the threshold engine speed may be adjusted based on operating conditions, such as transient conditions. In one example, the threshold speed may be lowered during a tip-in event.

Referring back now to FIG. 6, the graph 600 illustrates the difference in the effective controller gain values in the feedback control depending on whether both even and uneven edge readings are used for feedback control (e.g., Set 1 602), or whether only even edges are used (e.g., Set 2 604).

As noted above, the feedback control can further include adjustments to the gain values to take into account the fact that when using both even and uneven edges for cam timing sensing and control, multiple samples can occur closer to one another during some conditions and further apart during other conditions in a repeating pattern as the cam toothed wheel rotates. This is in contrast to the conditions where only even spaced data is utilized, in which case the samples occur at even spacing. In one approach, even when unevenly spaced readings are utilized, the controller can ignore the variation in sample spacing and simply determine control output based on the determined error values at each sample (and possibly based on one or more previous samples) without regard to the variation in controller updates.

In another example, rather than ignoring the uneven sample spacing for controller design, the controller may vary one or more control gains. For example, each particular edge reading may correspond to a specific controller gain corresponding to its particular relative sensing position as compared to an even tooth. An example base position table, Table 1, is shown below, that includes base position for each edge, and example gain sets. For the first edge, rising edge A (AR), a sample reading timing and position are included. For each other edge in the table, sample reading of timing and position would be determined in a similar manner (e.g., the position of falling edge A would be y-$b_{AF}$, etc.).

TABLE 1

| EDGE | Base timing | Controller gain set 1 (low speed) | Controller gain set 2 (high speed) | Sample Reading of timing | Position |
|---|---|---|---|---|---|
| AR ("A" "Rising") | $b_{AR}$ | $p1_{AR}$ | $p2_{AR}$ | y | y-$b_{AR}$ |
| AF ("A" "Falling") | $b_{AF}$ | $p1_F$ | $p2_F$ | | |
| BR ("B" "Rising") | $b_{BR}$ | $p1_{BR}$ | $p2_{BR}$ | | |
| BF ("B" "Falling") | $b_{BF}$ | $p1_F$ | $p2_F$ | | |
| CR ("C" "Rising") | $b_{CR}$ | $p1_{CR}$ | $p2_{CR}$ | | |
| CF ("C" "Falling") | $b_{CF}$ | $p1_F$ | $p2_F$ | | |
| DR ("D" "Rising") | $b_{DR}$ | $p1_{DR}$ | $p2_{DR}$ | | |
| DF ("D" "Falling") | $b_{DF}$ | $p1_F$ | $p2_F$ | | |

Because falling edges come evenly, a first controller with a common gain may be used for any falling edge data point, but for uneven edges, the controller gain may be adjusted to the specific edge. In this embodiment, two controllers may be run as follows:

Upon detection of a falling edge:

e(k)=difference between base crank position and crank position measured at falling edge for current sample (see Table 1 above).

$u_F(k)=p_{F1}*e(k)+ \ldots$ where k is incremented upon each falling edge. This example shows proportional control only, however, various other types of control may be added in other embodiments, such as integral, derivative, non-linear, etc. (e.g., $p_{F2}*e(k-1)$ may be added to the end of the series).

Upon detection of a rising edge:

e(i)=difference between base crank position and crank position measured at falling edge for current sample (see Table 1 above).

Here, the gain may be tracked to the sample order, as indicated in the Table 1 above. For example, when reading the rising edge of period D, the following applies:

$u_R(i)=p_{RD}*e(i)+ \ldots$ where i is incremented upon each rising edge.

Likewise, specific filtering gains may be applied depending on whether even or uneven spaced cam position data is utilized. Further, specific filter parameters may be included for each of the uneven data points depending on which uneven data point is sampled, according to the Table above, as described for the controller gains.

FIG. 7 shows a graph 700 illustrating an example cam step response using three feedback control strategies. In the example depicted, the position of the camshaft may start at its base position, e.g., advanced 0° CA relative to crankshaft position. The controller may set an advanced cam position of 35° CA. In response, the position of the cam may be adjusted, based on feedback from the cam position sensing system. In an example system wherein the controller receives infinite feedback, the cam position may be adjusted from 0° CA to 35° CA relative to crankshaft position following the solid line curve. However, because the controller typically only receives cam position feedback periodically (as in previous systems and the embodiment of the present disclosure) the cam position may not change according to the idealized curve but may change in a step-wise manner. The dotted line illustrates the feedback strategy of systems wherein cam position is only reported based on the even edges, while the dashed-dotted line illustrates the feedback system of an embodiment of the present disclosure, wherein the cam position is reported with both the even and uneven edges. As seen from the depicted examples of graph 700, when utilizing only evenly spaced edges (e.g., the dotted line), the cam position is controlled less precisely, and may result in a position overshoot, than when all edges are reported (e.g., the dashed-dotted line).

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine method, comprising:

adjusting a variable cam actuator responsive to cam position feedback from even and uneven readings of a toothed cam wheel, wherein one edge of each tooth of the toothed cam wheel is evenly spaced around the wheel to generate the even readings and another edge of each tooth is unevenly spaced around the wheel to generate the uneven readings, all of the edges generating the uneven readings being unequally spaced.

2. The method of claim 1, wherein cam position is a relative angle between cam position and crankshaft position.

3. The method of claim 2, wherein the toothed cam wheel includes four teeth, with two teeth having a smaller tooth width and two teeth having a greater tooth width, where one edge of each tooth is evenly spaced around the wheel to generate the even readings, and another edge of each tooth is unevenly spaced around the wheel to generate the uneven readings.

4. The method of claim 2, wherein the relative angle is further relative to a base cam position.

5. The method of claim 1, wherein the adjusting of the variable cam actuator occurs during feedback position control of cam timing during warmed-up engine operation.

6. The method of claim 5, wherein a first feedback control adjustment gain is applied to feedback from even readings, and a second, different feedback control adjustment gain is applied to feedback from uneven readings.

7. The method of claim 1, further comprising filtering the uneven readings differently than the even readings.

8. The method of claim 1, wherein the adjusting responsive to cam position feedback from even and uneven readings is during engine speed below a threshold speed, and above the threshold speed, the variable cam actuator is adjusted responsive to cam position feedback from only the even readings.

9. The method of claim 8, wherein during engine speed operation below the threshold, a first controller gain adjusts the variable cam actuator responsive to an error between a desired position and the feedback cam position, and during engine speed operation above the threshold, a second controller gain adjusts the variable cam actuator responsive to the error between the desired position and the feedback cam position.

10. An engine method, comprising:

during low engine speeds, adjusting a variable cam timing (VCT) actuator responsive to cam timing feedback from even and uneven edge readings of a toothed cam sensor wheel; and during high engine speeds, adjusting the VCT actuator responsive to cam timing feedback only from even edge readings of the toothed cam sensor wheel.

11. The method of claim 10, wherein cam timing is relative to crankshaft timing.

12. The method of claim 11, wherein the toothed cam wheel includes four teeth, with two teeth having a smaller tooth width and two teeth having a greater tooth width, where one edge of each tooth is evenly spaced around the wheel to generate the even readings, and another edge of each tooth is unevenly spaced around the wheel to generate the uneven readings, and where the two narrower teeth are adjacent one another around the wheel.

13. The method of claim 12, wherein the adjusting of the VCT actuator occurs during feedback control of cam timing during warmed-up engine operation.

14. The method of claim 13, wherein a first feedback control adjustment gain is applied to feedback from even readings, and a second, different feedback control adjustment gain is applied to feedback from uneven readings.

15. The method of claim 10, further comprising filtering the uneven edge readings differently than the even edge readings.

16. An engine system, comprising:

a crankshaft;

an intake camshaft adjustable relative to the crankshaft via a cam actuator and having a toothed wheel with a plurality of narrower teeth and a plurality of wider teeth, with each tooth having an evenly spaced edge and an unevenly spaced edge with respect to each other, all of the unevenly spaced edges being unequally spaced; and a controller including code to adjust the actuator responsive to readings from both even and uneven edges during a first condition, and responsive to readings from only even edges during a second condition.

17. The engine system of claim 16, wherein the toothed wheel includes four teeth, with two teeth having a narrower tooth width and two teeth having a wider tooth width, and where the two narrower teeth are adjacent one another around the wheel.

18. The engine system of claim 16, wherein the first condition comprises engine speed below a threshold speed, and the second condition comprises engine speed above the threshold speed.

19. The engine system of claim 18, wherein the threshold speed is adjusted based on a transient condition.

20. The engine system of claim 19, wherein the threshold speed is lowered during a tip-in event.

* * * * *